US005897266A

United States Patent [19]

Robert

[11] Patent Number: 5,897,266

[45] Date of Patent: Apr. 27, 1999

[54] VENT SYSTEM FOR WRITING INSTRUMENT

[75] Inventor: Beth Robert, Mattapoisett, Mass.

[73] Assignee: The Gillette Company, Boston, Mass.

[21] Appl. No.: 08/818,595

[22] Filed: Mar. 14, 1997

Related U.S. Application Data

[63] Continuation-in-part of application No. 08/756,396, Nov. 27, 1996, abandoned.

[51] Int. Cl.[6] ..... B43K 5/00

[52] U.S. Cl. ..... 401/202; 401/52

[58] Field of Search ..... 401/202, 52; 15/424, 15/427, 428, 430, 431, 432

[56] References Cited

U.S. PATENT DOCUMENTS

| | | | |
|---|---|---|---|
| D. 146,181 | 1/1947 | Lippincott | D74/1 |
| D. 171,093 | 12/1953 | Lovejoy | D74/17 |
| D. 198,419 | 6/1964 | Hankins | D74/17 |
| D. 217,647 | 5/1970 | De Groft | D19/6 |
| D. 239,280 | 3/1976 | Taylor | D19/6 |
| D. 312,096 | 11/1990 | Vitrac | D19/51 |
| D. 330,911 | 11/1992 | Tu | D19/51 |
| D. 341,623 | 11/1993 | Chuang | D19/36 |
| D. 349,297 | 8/1994 | Shimizu | D19/57 |
| D. 351,417 | 10/1994 | Oka | D19/57 |
| D. 357,699 | 4/1995 | Takanashi | D19/48 |
| D. 359,759 | 6/1995 | Otake | D19/57 |
| D. 366,497 | 1/1996 | Otake | D19/51 |
| 1,104,514 | 7/1914 | Kilstrom | 15/429 |
| 2,417,925 | 3/1947 | Gerster-Seiler | 15/432 |
| 2,495,178 | 1/1950 | Norlin | 15/432 |
| 2,690,735 | 10/1954 | Lopez | 15/432 |
| 3,917,416 | 11/1975 | Steyer | 401/34 |
| 4,376,590 | 3/1983 | Kuo | 401/57 |
| 4,915,529 | 4/1990 | List | 401/202 |
| 5,000,603 | 3/1991 | Isoda | 401/202 |
| 5,000,604 | 3/1991 | Isoda | 401/202 |
| 5,054,949 | 10/1991 | Heger | 401/202 |
| 5,061,105 | 10/1991 | Isoda | 401/202 |
| 5,114,258 | 5/1992 | Yasunaga | 401/202 |
| 5,127,754 | 7/1992 | Mase | 401/202 |
| 5,176,460 | 1/1993 | Garry | 401/202 |
| 5,186,564 | 2/1993 | Fuhrmann, III et al. | 401/202 |
| 5,221,152 | 6/1993 | Chuang | 401/57 |

FOREIGN PATENT DOCUMENTS

| | | | |
|---|---|---|---|
| 08332798 | 12/1996 | European Pat. Off. | B43K 29/02 |
| 09066697 | 3/1997 | European Pat. Off. | B43K 29/92 |
| 39 21 780 A1 | 1/1991 | Germany | 401/243 |
| 2 248 586 | 4/1992 | United Kingdom . | |

*Primary Examiner*—David J. Walczak

*Attorney, Agent, or Firm*—Donal B. Tobin; Chester Cekala; Aubrey C. Brine

[57] ABSTRACT

A writing instrument having a removable cap with an eraser at one end, the eraser being received and retained within the cap. An air passage is provided through the cap to allow for emergency respiration should the cap be accidently swallowed. The eraser may alternatively be disposed in the writing instrument barrel with an air passage provided through the barrel and exhausting through the barrel wall.

11 Claims, 6 Drawing Sheets

VENT SYSTEM FOR WRITING INSTRUMENT

This is a Continuation-In-Part of 08/756,396 filed Nov. 27, 1996, now abandoned.

BACKGROUND OF THE INVENTION

The present invention relates to writing instruments and more particularly to a writing instrument or cap therefor having an air passage provided through the cap or instrument to allow for emergency respiration should the item be accidentally lodged in a person's breathing passage.

There are many types of writing instruments having an eraser provided in the cap, or on the barrel of the instrument, the writing instruments and their caps being obtainable in many sizes, from the very small to large. The writing instrument may be either a pen of the ballpoint or other type, or a lead pencil. In each case the item generally has a means for removing the particular marking which is provided in the form of an eraser extending beyond the top of the cap, or the top of the barrel of the instrument.

In many instances, when the cap or barrel itself containing the eraser is relatively small, the item may provide an attractive article for a small child, or even a small animal. In the event that a tubular device forming the cap of the writing instrument or the instrument itself should be swallowed, it has been suggested that means be provided (if needed) to aid in the victim's breathing until the article could be dislodged by emergency procedures.

It is, therefore, an object of the present invention to provide a cap having an eraser extending from one end thereof for use with a writing instrument or the like, wherein an air passage is provided through the cap to allow for emergency respiration should the cap be accidently swallowed.

A further object of the present invention is to provide a cap having an eraser provided thereon for use with a writing instrument or the like, in which a breathing passage is provided between the eraser and the body of the cap.

Yet another object of the invention is to provide a cap of the type described which is simple to manufacture and requires no special modification to the writing instrument.

A further object of the invention is to provide a writing instrument having a barrel with an eraser provided at one end thereof wherein an air passage is provided through the barrel for emergency respiration should the instrument itself be swallowed.

SUMMARY OF THE INVENTION

The above objects, and other objectives which will become apparent as the description proceeds, are accomplished by providing a cap for use with a writing instrument or the like which comprises an elongated tubular hollow body member having an eraser formed of substantially solid material received in one end of the hollow body and extending therefrom. An air passage means is disposed between the eraser and the inner surface of the body member for allowing passage of air from the one end of the body member, and through the body member.

The eraser is generally of elongated cylindrical form and the air passage means may be formed by means disposed on the inner surface of the body member for contacting the eraser and maintaining the eraser in spaced relation with the body member inner surface.

The means disposed on the inner surface of the body member may comprise a plurality of barbs disposed radially inwardly of the body member inner surface and extending longitudinally in the body member, the barbs generally being at least three in number.

The cap further may be provided with shelf means disposed within the body member for contact with the opposite end of the eraser from that end extending from the body member, and guide means may be disposed on the inner surface of the body member for centering the eraser between the plurality of barbs during insertion of the eraser into the body member. The guide means may comprise a plurality of elongated arcuate ridge members extending longitudinally in the body member.

As an alternate form, the eraser may comprise an elongated cylindrical member having a plurality of radially outwardly extending protrusions disposed about the outer surface thereof for contacting the inner surface of the body member and maintaining the eraser in spaced relation with the body member inner surface.

As another alternative form, both the eraser and the body member may have co-operating radially outwardly and radially inwardly protrusions for contacting the inner surface of the body member and maintaining the eraser in spaced relation with the body member inner surface.

A writing instrument embodying the invention comprises an elongated tubular hollow barrel having writing means disposed at one end and an eraser formed of a substantially solid material received in the opposite end of the barrel. Air passage means is provided between the eraser and the inner surface of the barrel, and an opening is formed in the barrel between the eraser and the writing means for exhaust of air from the barrel.

BRIEF DESCRIPTION OF THE DRAWING

The foregoing and other features of the invention will be more particularly described in connection with the preferred embodiments, and with reference to the accompanying drawing, wherein.

DESCRIPTION OF THE PREFERRED EMBODIMENT

Figure 1:
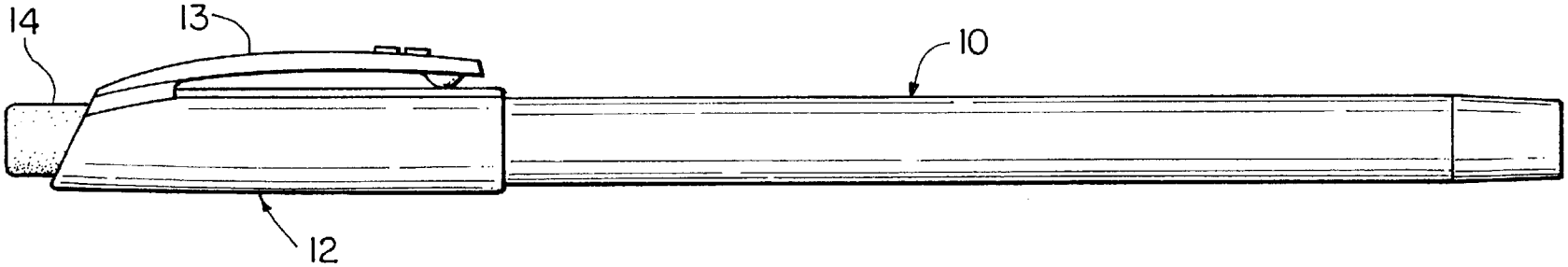
FIG. 1 is an elevational view showing a writing instrument having a cap provided with an eraser, and constructed in accordance with the teachings of the present invention.
Figure 2:
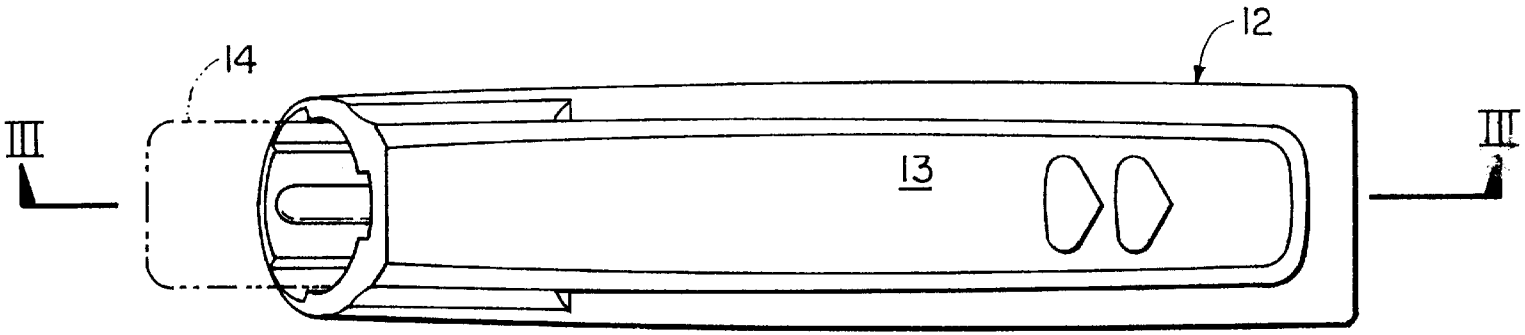
FIG. 2 is an elevational view showing the cap of the writing instrument of FIG. 1 taken on an enlarged scale for clarity.

Referring now to the drawing and in particular to FIGS. 1 and 2 there is shown a writing instrument 10 having a writing means (not shown) which when not in use is covered by a cap 12. The cap 12 is provided with a clip 13 which will not be described in detail, but may be of any type well known in the art, and an eraser 14. The eraser 14 extends longitudinally beyond the cap and is placed on the opposite end of the writing instrument 10 from that shown in FIG. 1, with the writing tip of the instrument uncovered for use. The eraser 14 is of elongate cylindrical form and may be formed of any suitable material for removing a particular writing substance, be it ink or pencil lead, and for quality of performance is best comprised of a substantially solid material.

Figure 3:
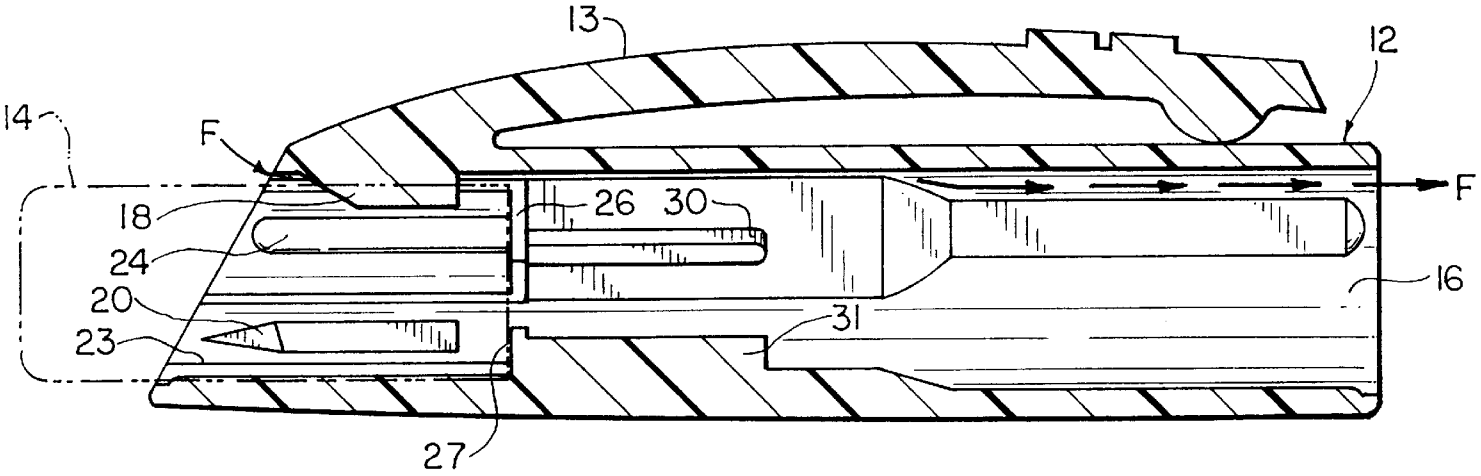
FIG. 3 is an elevational sectional view taken along the line III—III of FIG. 2 showing details of the structure of FIG. 2.
Figure 5:
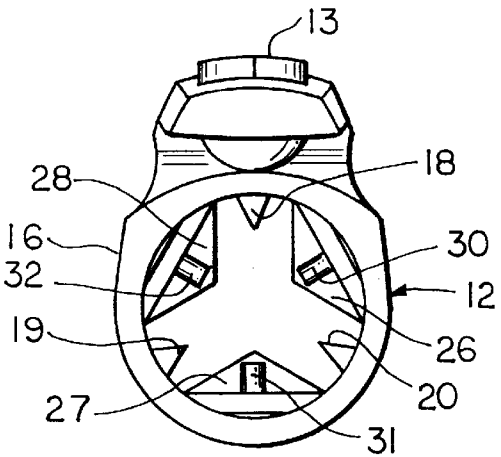
FIG. 5 is an elevational view of the structure of FIGS. 2 through 4, showing that end of the cap opposite that of FIG. 4.
Figure 4:
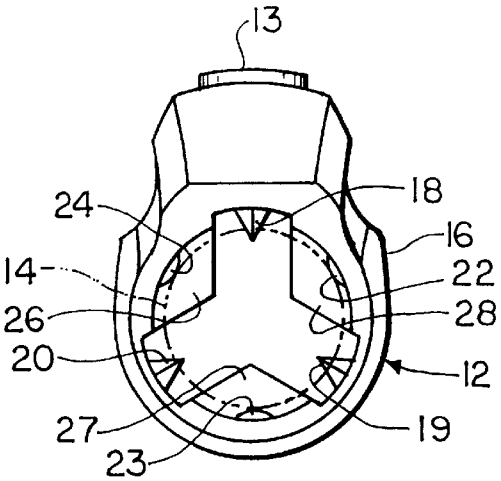
FIG. 4 is an elevational view of the structure of FIGS. 2 and 3 showing that end of the cap having the eraser mounted therein.

Referring now to FIGS. 3, 4 and 5, the cap 12 is shown to comprise an elongate tubular hollow body member 16, which is generally of molded plastic material and may have the clip 13 integrally molded onto the body member as shown in FIG. 3. Within the opening which is to receive the eraser 14 there are provided three barbs 18, 19 and 20, equally spaced about the inner surface of the body member 16, and disposed radially inwardly of the body member and extending longitudinally of the inner surface.

A plurality of guide members 22, 23 and 24 in the form of elongated arcuate ridges, three in number, are disposed about the inner surface of the cap 12 to ensure that the eraser 14 is substantially centered within the opening and contacting each of the barbs 18, 19 and 20, such that approximately equal impalement of each barb occurs.

Shelf means in the form of a plurality of shelf portions 26, 27 and 28 are disposed within the body member 16 adjacent the opening in which the eraser 14 is inserted, and located across the bore of the cap to contact the opposite end of the eraser from the end extending from the body member. As best shown in FIG. 3, each of the shelf portions 26, 27 and 28 is provided with respective stop ribs 30, 31 and 32 which extends longitudinally within the opening in the body member 16 and stop insertion of the writing instrument within the cap at a desired location. The remainder of the configuration within that portion of the body member 16 opposite the eraser 14 will not be described in detail in that it may take any form which is essential to retain the cap 12 onto either end of the writing instrument 10, depending on whether the instrument is, or is not, in use.

As is evident from FIG. 3, should the cap 12 become accidently lodged in the throat, breathing passages are provided around the eraser 14 and through the bore of the body member 16, the flow travelling around the barbs 18, 19 and 20 as shown by the flow line F in FIG. 3.

Figure 6:
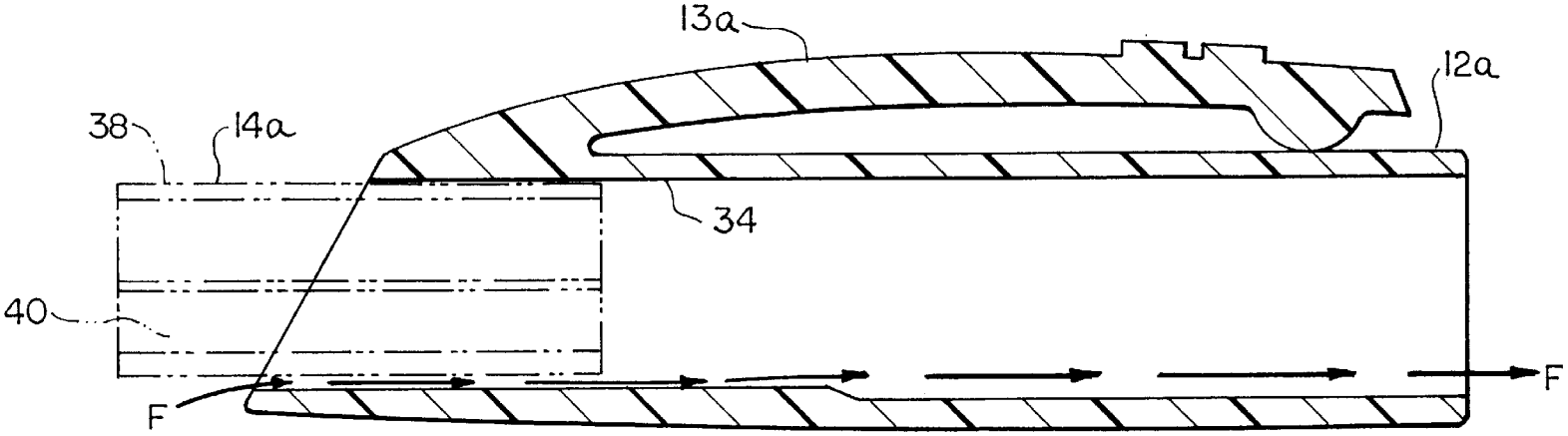
FIG. 6 is an elevational sectional view similar to FIG. 3 showing a cap constructed with an alternate embodiment of the invention.
Figure 8:
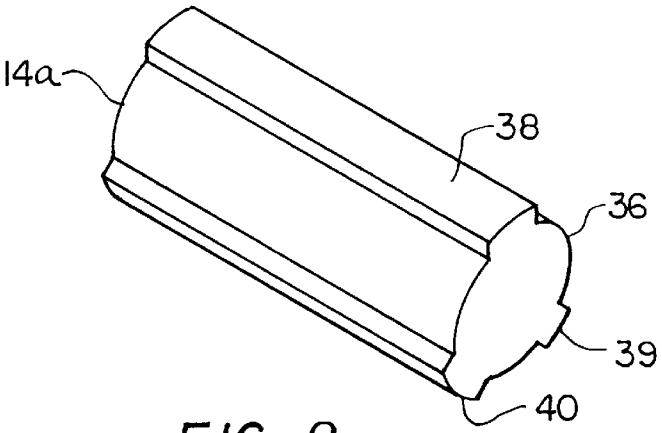
FIG. 8 is a perspective view showing the eraser employed in the cap of FIGS. 6 and 7.
Figure 7:
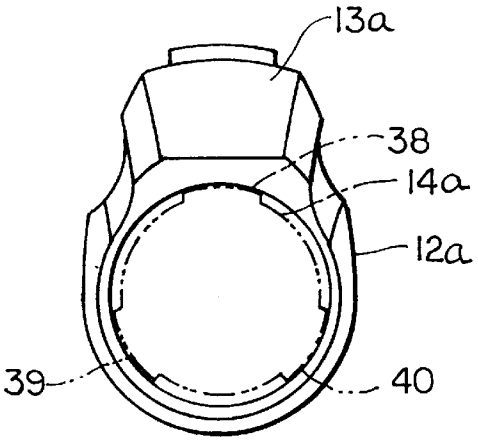
FIG. 7 is an elevational view of the structure of FIG. 6 showing that end of the cap having the eraser mounted therein.

Referring now to FIGS. 6, 7 and 8, an alternate embodiment of the invention is shown wherein a cap 12*a* having a clip 13*a* and eraser 14*a* is provided, the cap 12*a* and clip 13*a* having similar outer dimensions to that of the cap 12 and clip 13. However, the cap 12*a* is provided with a smooth cylindrical bore producing a cylindrical surface 34 into which the eraser 14*a* is received. The eraser 14*a*, as shown in FIG. 8, comprises a cylindrical body 36 similar to the eraser 14 with a plurality, three in number, of radially outwardly projecting protrusions 38, 39 and 40. The radially outwardly projection of the protrusions 38, 39 and 40 is such as to provide an interference fit with the inner surface 34 when the eraser 14*a* is inserted into the cap 12*a*. As demonstrated in FIG. 6, with the eraser 14*a* in place the air flow through the cap 12*a* takes place between the cylindrical body 36 of the eraser 14*a* and the inner surface 34 of the cap 12*a*. Thus, the objective of the invention is achieved while the integrity of the eraser 14*a* is not compromised in that the solid cylindrical body 36 remains effective for the erasing process.

Figure 9:
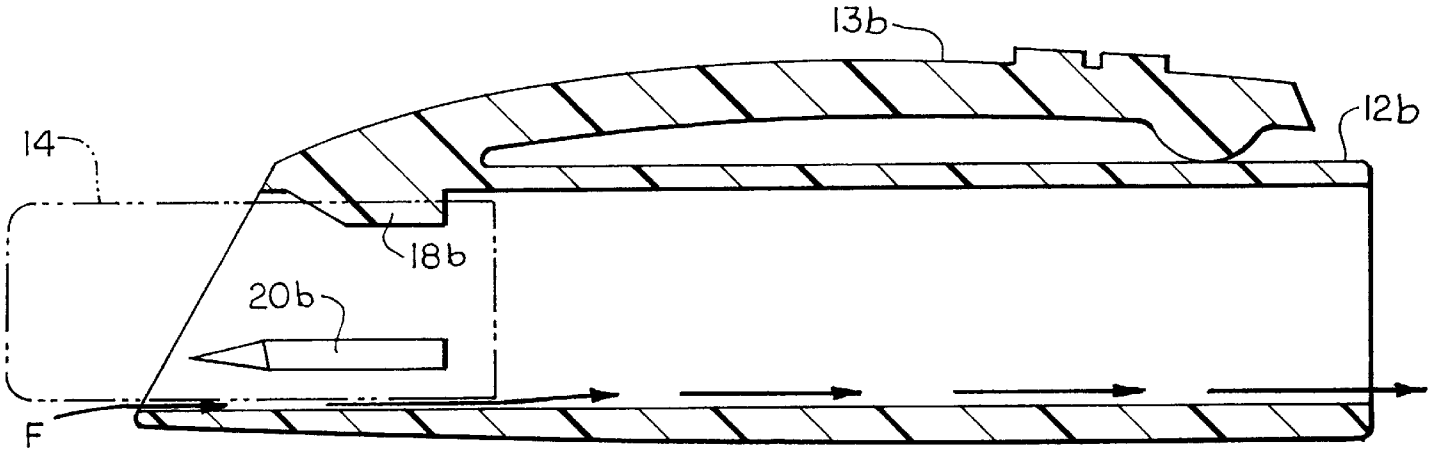
FIG. 9 is an elevational sectional view similar to FIGS. 3 and 6 showing a cap constructed with another alternate embodiment of the invention.
Figure 10:
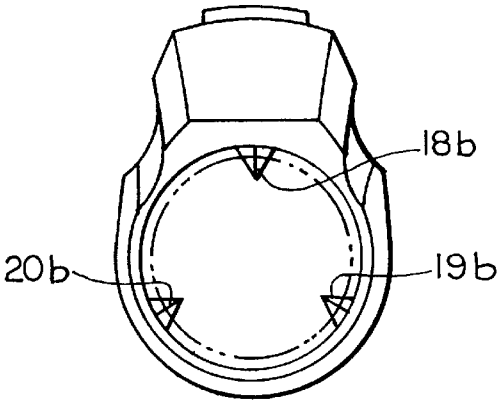
FIG. 10 is an elevational view of the structure of FIG. 9 showing that end of the cap having the eraser mounted therein.

Reference should now be made to FIGS. 9 and 10 wherein a simplified construction is shown which is similar to that structure described with reference to FIGS. 3, 4 and 5. As shown in FIG. 9, a cap 12*b* having a clip 13*b* is designed to be employed with the eraser 14 as described above. In the cap 12*b*, however, there are merely provided three barbs 18*b*, 19*b* and 20*b*. The barbs 18*b*, 19*b* and 20*b* when placed about the inner cylindrical surface of the cap 12*b* are of an inwardly projection which is sufficient to retain the eraser 14 in spaced relation with the inner surface of the cap 12*b*, thereby providing a flow of air as shown in FIG. 9, and achieving the objective of the present invention.

Figure 11:
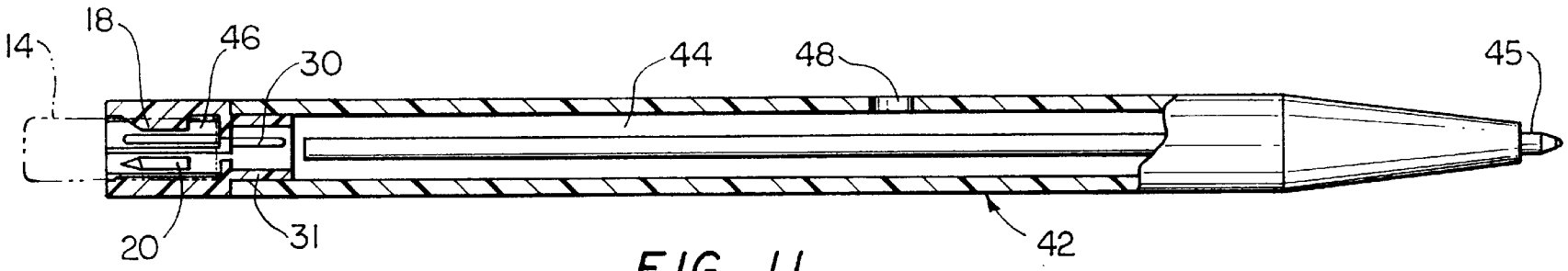
FIG. 11 is an elevational view, partially in section, showing a writing instrument constructed as an alternate embodiment employing the teachings of the present invention.

Referring now to FIG. 11, a pen of the ballpoint type is shown having a barrel 42 which is substantially divided into a stylus portion 44 and an eraser portion 46. The stylus portion 44 of the barrel 42 is a tubular cylinder having a writing implement 45 disposed therein, the writing implement being of any ballpoint type well known in the art.

With reference to the erasing portion 46 of the barrel 42, the internal construction of the erasing portion is of a construction identical to that described with reference to FIGS. 3, 4 and 5 (or that of FIGS. 6–8, or FIGS. 9–10) and will, therefore, not be described again in detail. As with the structure shown in FIGS. 3, 4 and 5, should the barrel 42 of the pen become lodged in a breathing passage, airflow would take place in the space between the eraser 14 and the inner wall of the erasing portion 46, and through the stylus portion 44 to an opening 48 in the barrel 42 located remotely from the end of the barrel containing the eraser 14. While the opening 48 is shown formed in the barrel 42, it should be well recognized that the opening 48 may be formed where the writing implement 45 projects from the writing end of the barrel 42.

Figure 12:
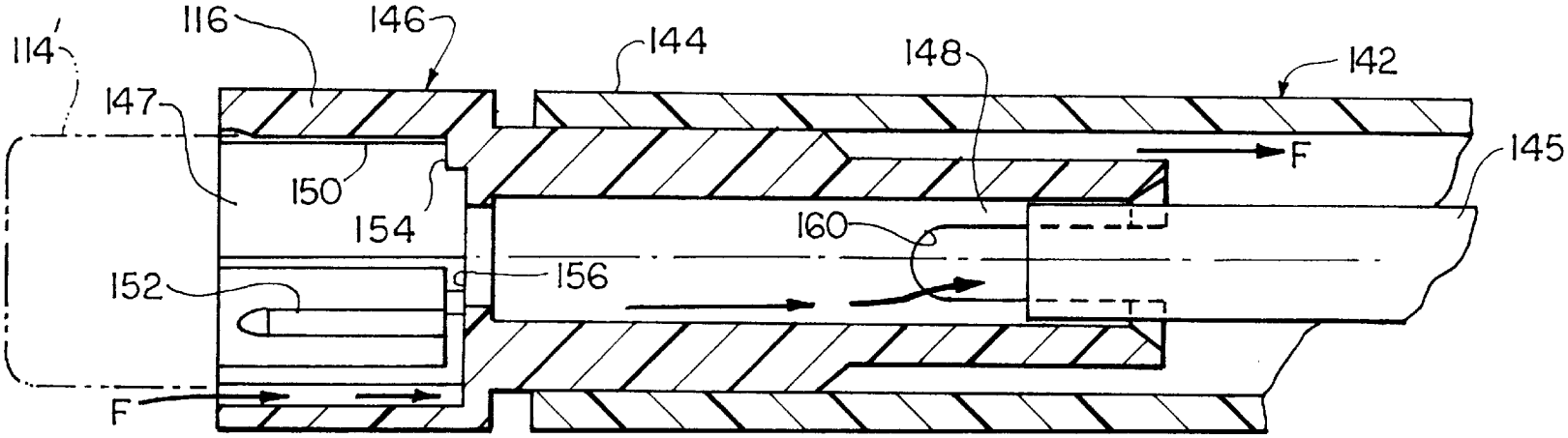
FIG. 12 is an elevational sectional view showing an alternate embodiment of a portion of the structure of FIG. 11, taken on an enlarged scale for clarity.
Figure 13:
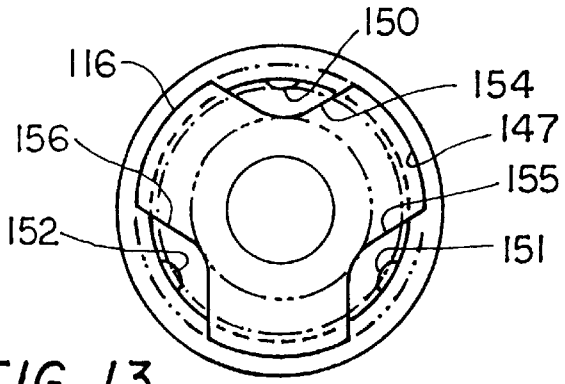
FIG. 13 is an end view of the embodiment of FIG. 12 showing further details of that structure.

In FIGS. 12 and 13 there is shown an alternate embodiment of a writing instrument similar to that shown in FIG. 11, the instrument containing a barrel 142 which is divided into a stylus portion 144 and an eraser portion 146. As in FIG. 11, the stylus portion 144 of the barrel 142 is comprised of a tubular cylinder having a writing implement 145 disposed therein. The writing implement 145 may be a ballpoint pen having a tubular ink-containing member extending upwardly in the barrel 142 to the eraser portion 146, or may be a mechanical pencil of the type having an activation mechanism extending upwardly into the eraser portion, in which case the eraser portion would be movable within the stylus portion 144 to forward the lead to its writing position.

In either case, that of the ballpoint pen or mechanical pencil, the eraser portion 146 comprises a tubular hollow body member 116 molded of plastic material having an opening into a cavity 147 at one end to receive an eraser 114. A smaller diameter cavity 148 is disposed at the opposite end of the eraser portion 146 for receiving the upper extremity of the writing implement 145, as shown.

In a similar manner to the previously-described embodiments, the innermost wall of the cavity 147 contains a plurality of guide members 150, 151 and 152 in the form of elongated arcuate ridges, equally spaced about the inner wall surface of the cavity 147. Each of the guide members 150, 151 and 152 extends axially in the cavity 147 to terminate at a plurality of shelf portions 154, 155 and 156, respectively. As will be noted in FIG. 13, the innermost wall of the cavity 147 is of a smaller diameter where the shelf portions 154, 155 and 156 are located than the diameter of the remaining cross-sectional area of the cavity. An eraser 114 is formed of a diameter which is capable of being forced into the cavity 147, to rest upon the shelf portions 154, 155 and 156. As the outer diameter of the eraser 114 is of a dimension that closely approximates that of the innermost wall diameter of the cavity 147 at the shelf portions 154, 155 and 156, the eraser is retained within the cavity by interference fit with the guide members 150, 151 and 152.

As is evident from FIGS. 12 and 13, the difference between the wall diameters of the cavity 147, as cited above, provides air passages between the eraser and the maximum wall diameter of the cavity 147 to provide air flow therethrough and into the cavity 148 of the eraser portion 146.

As best shown in FIG. 12, a slot 160 is provided in the wall of the cavity 148 at the portion receiving the writing implement 145. Thus, as shown in FIG. 12, air flow F is provided through the gap between the eraser 114 and the large diameter wall of the cavity 147, into the cavity 148, through the slot 160 into the stylus portion 144 and out through an opening (not shown) in the barrel 142. The opening in the barrel 142 may be of a type and location similar to the opening 48 shown in the stylus 44 of the device of FIG. 11.

From the foregoing description of the preferred embodiments of the invention it should be appreciated that in each of the structures show the eraser has been maintained in a structural configuration which does not inhibit its usefulness during the life of the writing instrument. Also, in each instance, an air passage is provided through the device to allow for emergency respiration should the device be accidentally swallowed, thus achieving the primary objectives of the invention.

While it is apparent that changes and modifications can be made within the spirit and scope of the present invention, it is my intention, however, only to be limited by the appended claims.

As my invention I claim:

1. A cap for use with a writing instrument, said cap comprising:

a tubular hollow body member having an elongate inner surface;

an elongate eraser formed of substantially solid material having a substantially cylindrical outer surface over its length, said eraser received in said hollow body with an end portion thereof extending from said hollow body;

an air passage formed between said eraser outer surface and said inner surface of said body member for allowing passage of air from said one end of said body member and through said body member; and means projecting radially inwardly of said body member inner surface and extending longitudinally of said body member inner surface, said means comprising a plurality of barbs for providing contact between said eraser and said body member inner surface while maintaining said eraser in spaced relation with said body member inner surface to form said air passage.

2. A cap as set forth in claim 1 wherein said plurality of barbs is at least three in number.

3. A cap as set forth in claim 2 wherein said means projecting radially inwardly of said body member further includes guide means disposed on said body member inner surface for centering said eraser between said plurality of barbs during insertion of said eraser into said body member.

4. A cap as set forth in claim 3 wherein said guide means comprises a plurality of elongated arcuate ridge members extending longitudinally in said body member.

5. A cap as set forth in claim 4 which further includes shelf means disposed within said body member for contact with the opposite end of said eraser from said portion extending from said body member.

6. A cap as set forth in claim 1 wherein said means projecting radially inwardly of said body member includes guide means disposed on said body member inner surface for centering said eraser between said plurality of barbs during insertion of said eraser into said body member.

7. A cap as set forth in claim 6 wherein said guide means comprises a plurality of elongated arcuate ridge members extending longitudinally in said body member.

8. A cap as set forth in claim 1 which further includes shelf means disposed within said body member for contact with the opposite end of said eraser from said end portion extending from said body member.

9. A cap for use with a writing instrument, said cap comprising:

a tubular hollow body member having an elongate inner surface;

an elongate eraser formed of substantially solid material having a substantially cylindrical outer surface over its length, said eraser received in said hollow body with an end portion thereof extending from said hollow body;

an air passage formed between said eraser outer surface and said inner surface of said body member for allowing passage of air from said one end of said body member and through said body member; and means projecting radially inwardly of said body member inner surface and extending longitudinally of said body member inner surface comprising a plurality of radially outwardly extending protrusions disposed about the outer surface of said eraser for contacting said body member inner surface and maintaining said eraser in spaced relation with said body member inner surface to form said air passage.

10. A writing instrument comprising:

a tubular hollow barrel having an elongate inner surface and writing means disposed at one end thereof;

an elongate eraser formed of substantially solid material having a substantially cylindrical outer surface over its length, said eraser received in the end of said barrel opposite said writing means;

an air passage formed between said eraser outer surface and said inner surface of said body member for allowing passage of air into said barrel at said end of said barrel opposite said writing means;

means projecting radially inwardly of said barrel inner surface comprising a plurality of barbs for providing contact between said eraser and said barrel inner surface while maintaining said eraser in spaced relation with said barrel to form said air passage; and an opening formed through said barrel between said eraser and said writing means for exhaust of air from said barrel.

11. A writing instrument as set forth in claim 10 wherein said plurality of barbs is at least three in number.

* * * * *